US012146330B2

(12) United States Patent
Arge

(10) Patent No.: US 12,146,330 B2
(45) Date of Patent: Nov. 19, 2024

(54) MOBILE CABIN WITH VENTILATION SYSTEM AND A METHOD FOR VENTILATION THEREOF

(71) Applicant: SILEN OÜ, Tallinn (EE)

(72) Inventor: Endrus Arge, Tallinn (EE)

(73) Assignee: SILEN OÜ, Tallinn (EE)

( * ) Notice: Subject to any disclaimer, the term of this patent is extended or adjusted under 35 U.S.C. 154(b) by 428 days.

(21) Appl. No.: 17/423,628

(22) PCT Filed: Jan. 15, 2020

(86) PCT No.: PCT/IB2020/050306
§ 371 (c)(1),
(2) Date: Jul. 16, 2021

(87) PCT Pub. No.: WO2020/148674
PCT Pub. Date: Jul. 23, 2020

(65) Prior Publication Data

US 2022/0098884 A1 Mar. 31, 2022

(30) Foreign Application Priority Data

Jan. 18, 2019 (EE) ..... P201900004

(51) Int. Cl.
*E04H 1/12* (2006.01)
*E04B 1/343* (2006.01)
(Continued)

(52) U.S. Cl.
CPC ..... *E04H 1/125* (2013.01); *E04B 1/34336* (2013.01); *E04B 1/8218* (2013.01);
(Continued)

(58) Field of Classification Search
CPC ... E04H 1/125; E04B 1/34336; E04B 1/8218; F24F 7/025; F24F 7/10; F24F 7/007; F24F 13/24
(Continued)

(56) References Cited

U.S. PATENT DOCUMENTS 2,962,132 A * 11/1960 Reinhardt ..... E04B 2/7422 52/27
3,058,411 A * 10/1962 Hanson ..... F24F 7/10 181/292
(Continued)

FOREIGN PATENT DOCUMENTS

CN 101858154 A * 10/2010 ..... A47C 29/003
CN 104864540 A * 8/2015 ..... F24F 7/06
(Continued)

OTHER PUBLICATIONS

PCT/IB2020/050306, International Search Report issued on May 20, 2020, 4 pgs.
(Continued)

*Primary Examiner* — Brian D Mattei
*Assistant Examiner* — Joseph J. Sadlon
(74) *Attorney, Agent, or Firm* — Koivula & Somersalo, LLC

(57) ABSTRACT

The invention discloses a mobile cabin with sound-absorbing features, whereas cabins may be interconnected, if necessary, by connection devices as modules into a larger set of cabins and detached again, if necessary, and used as individual cabins or smaller sets of cabins. The invention also discloses a method for ventilation of the mobile cabin.

12 Claims, 3 Drawing Sheets

(51) Int. Cl.
*E04B 1/82* (2006.01)
*F24F 7/02* (2006.01)
*F24F 7/10* (2006.01)
*F24F 13/24* (2006.01)

(52) U.S. Cl.
CPC ..... *F24F 7/025* (2013.01); *F24F 7/10* (2013.01); *F24F 13/24* (2013.01)

(58) Field of Classification Search
USPC ..... 52/79.1
See application file for complete search history.

(56) References Cited

U.S. PATENT DOCUMENTS 3,115,819 A * 12/1963 Mahlmeister ..... E04H 1/12 454/251
3,124,903 A * 3/1964 Truhan ..... A01G 9/246 47/17
3,302,547 A * 2/1967 Wasserman ..... F24F 7/025 52/236.1
3,588,209 A * 6/1971 Nathan ..... A47B 43/00 312/258
3,593,469 A * 7/1971 Wall ..... E03C 1/01 52/27
3,611,907 A * 10/1971 Wasserman ..... E04B 1/8218 D25/16
3,710,525 A * 1/1973 Lopes ..... B60P 3/32 52/169.12
3,963,094 A * 6/1976 Nowikas ..... E04B 1/8218 181/198
3,982,475 A * 9/1976 Wild ..... F24F 13/24 454/238
4,478,467 A * 10/1984 Tyndall ..... B25H 1/12 312/258
4,560,320 A * 12/1985 Baus ..... F24F 7/013 138/155
4,594,817 A * 6/1986 McLaren ..... A47C 29/003 52/36.2
4,719,716 A * 1/1988 Chrisley, Jr. ..... A01M 31/025 D25/16
4,787,181 A * 11/1988 Witten ..... E04B 1/3483 220/4.21
4,788,802 A * 12/1988 Wokas ..... E04B 1/34869 52/34
5,123,874 A * 6/1992 White, III ..... E04B 1/34321 181/290
5,239,792 A * 8/1993 Avni ..... E04B 1/8209 52/282.4
5,285,617 A * 2/1994 Romig ..... B65D 90/24 52/79.9
6,200,215 B1 * 3/2001 Larsson ..... F24F 13/28 55/471
6,205,716 B1 * 3/2001 Peltz ..... H04N 7/142 379/453
6,217,281 B1 * 4/2001 Jeng ..... F04D 29/703 415/119
6,319,115 B1 * 11/2001 Shingaki ..... F24F 12/006 165/909
6,584,735 B2 * 7/2003 Burton ..... E04F 13/007 52/95
7,290,378 B2 * 11/2007 Kalnay ..... E04H 15/48 52/79.5
7,827,738 B2 * 11/2010 Abrams ..... E04H 1/04 52/79.1
7,832,087 B2 * 11/2010 Gilgan ..... E04B 1/35 29/897.3
8,276,223 B1 * 10/2012 Connor ..... A47C 29/003 135/96
8,621,787 B2 * 1/2014 Barry ..... E04B 1/34869 52/79.8
8,739,484 B2 * 6/2014 Antonic ..... E04D 13/1681 52/220.1
9,062,451 B1 * 6/2015 Wilson, Jr. ..... B60P 3/40
9,157,249 B2 * 10/2015 Segall ..... E04B 1/34384
10,100,509 B2 * 10/2018 Smith ..... B66F 3/46
10,197,297 B2 * 2/2019 Daniels, II ..... F24F 11/56
10,219,961 B2 * 3/2019 Patel ..... A61G 10/02
10,352,580 B2 * 7/2019 Kim ..... F24F 1/0057
10,612,239 B2 * 4/2020 Yau ..... E04C 2/34
10,654,534 B2 * 5/2020 Kamm ..... B62D 63/025
11,409,192 B2 * 8/2022 Shibuya ..... E04B 1/92
11,549,703 B2 * 1/2023 Haveri ..... F24F 7/06
2001/0018325 A1 * 8/2001 Adams ..... F24F 13/24 454/252
2002/0194796 A1 * 12/2002 Kress ..... E04H 3/08 52/79.1
2005/0108954 A1 * 5/2005 Sola ..... E04H 1/125 52/79.1
2007/0283488 A1 * 12/2007 Birdsall ..... E03C 1/01 4/622
2010/0197214 A1 * 8/2010 Geremia, Sr. ..... F24F 13/18 454/251
2011/0021134 A1 * 1/2011 Zwern ..... F24S 10/30 454/343
2011/0162292 A1 * 7/2011 Higley ..... E04B 1/12 52/302.1
2018/0363311 A1 * 12/2018 Liao ..... E04H 3/02

FOREIGN PATENT DOCUMENTS

CN 109 025 379 A 12/2018
EP 0340433 A2 * 11/1989 ..... F24F 13/24
EP 1959207 A1 * 8/2008 ..... F24F 13/24
JP H07 19519 U 4/1995
JP H10219889 A 8/1998
JP 2005097952 A * 4/2005 ..... E04B 1/34305
JP 2018 198251 A 12/2018
KR 20090122663 A 12/2009
KR 20100012145 A 2/2010
NL 8901055 A * 11/1990 ..... E04B 1/34336
WO WO-2010115616 A1 * 10/2010 ..... F24F 13/06
WO WO-2011013582 A1 * 2/2011 ..... F24F 13/068
WO 2017/181133 A1 10/2017
WO 2018/011462 A1 1/2018

OTHER PUBLICATIONS

PCT/IB2020/050306, Written Opinion of the International Searching Authority issued on May 20, 2020, 8 pgs.
Vank SP. O O.Z, Wall_2_Box, retrieved from <https://vank.pl/en/product/wall-2-box-1> on Nov. 8, 2021, available in Jan. 2020.

* cited by examiner

MOBILE CABIN WITH VENTILATION SYSTEM AND A METHOD FOR VENTILATION THEREOF

PRIORITY

This is a U.S. national stage application of international application number PCT/IB2020/050306 filed on Jan. 15, 2020, which claims priority to EE P201900004 filed on Jan. 18, 2019, the contents of both of which are incorporated herein by reference.

FIELD OF TECHNOLOGY

The invention belongs in the field of construction works, more specifically, the invention comprises a monolithic cabin with a ventilation system which is easy to relocate in a room and which has sound-absorbing features. The cabins can be interconnected as modules in mobile manner, forming larger cabin sets, if necessary, and detaching those into individual cabins or smaller sets of cabins again, if necessary. The cabin can, for instance, be used in an open office as a separate meeting room.

PRIOR ART

There are known to be several soundproof cabins used in open offices or other larger rooms for various purposes, e.g. as places for making phone calls or places for relaxing and/or resting or as meeting rooms for small work groups or video conference rooms, etc. In addition to sound-absorbing materials, such cabins also include an individual ventilation system and optionally also furniture, communication systems and lighting. Some known cabins have wheels, which facilitates their relocation; some have been solved as modular systems, which makes it possible to interconnect them.

For instance, cabins consisting of single wall elements by Vank S P. O O. Z "Wall" are known (https://vank.pl/en/product/wall2-box-1). This solution lacks wheels, which makes it difficult to relocate cabins consisting of individual wall elements, and modular structure here means that the wall elements have to be erected.

A capsule-shaped cabin is known (JPH10219889, Kokuo K K, published Aug. 18, 1998). Such a solution does not make it possible to unite cabins into a complete module.

A modular cabin is known (KR20100012145 Alti Electronics CO, LDT, published Feb. 8, 2010), which can be moved by wheels attached under the cabin, which move along guide rails. Such a solution lacks ventilation and the cabin can only be moved in one direction along the preset guide rails. Also, the cabin only rests on the wheels, which makes the cabin unstable during use.

An expandable mobile surveillance room on wheels is known (KR20090122663, Yoo On Boop, published Dec. 1, 2009), which comprises the main room with separate additional rooms attachable to the main room on both sides. A drawback of this solution is that the surveillance room only rests on the wheels, which makes it unstable during use. Also, it is not a soundproof cabin.

Closest to the invention by technical nature is international patent application WO2017181133 for a mobile cabin with ventilation and international patent application WO2018011462 for a ventilation method for mobile cabin.

International patent application WO2017181133 "Mobile cabin" (ZGF ARCH LLP, published Oct. 19, 2017) is a mobile workplace on wheels, with possibilities for use expandable by integrated furniture, which may be closed when not used, i.e. in closed position it is a closet with closed doors. The workplace may be disassembled for transport and easily reassembled for use. Several workplaces may be interconnected by hardware and form modules thereof with different shapes and purposes. A drawback of the solution is that it rests on the wheels, which makes it unstable during use. It is also not a soundproof cabin but an open workstation with also no need for a separate ventilation system.

International patent application WO2018011462 "Ventilation system and method" (Framery O Y, published Jan. 18, 2018) comprises a sound-absorbing cabin with a ventilation system and a method for ventilation thereof. The ventilation system comprises a ventilator mounted in the ceiling into an air inlet by which air enters into the cabin through a two-channel air duct and an air outlet penetrating the side wall or positioned into the floor, which create an air flow in the cabin, which is adjusted so that the amount of air is sufficiently large and the noise level from the external environment would not exceed the prescribed limit. A drawback of this solution is a two-channel air duct where in the first channel air is directed around the horizontal partition wall in reverse direction into the other air channel which reduces the power and speed of ventilation as well as the quantity of moving air in the cabin for this solution. Consequently, in order to increase air circulation sufficiently, it is necessary to increase the operating speed of the ventilators, which in turn increases the noise level entering the cabin through the air duct. Noise level entering the cabin from the external environment has also increased, as there are no sufficient means in the air duct for absorbing noise. Also, the use of air outlets positioned in the side wall of the cabin limits the use of the cabin (the cabin cannot be positioned e.g. next to another cabin or by the wall, as the outgoing air flow from the cabin would be blocked). Additionally, the air outlets penetrating the side wall increase the level of external noise in the cabin. It is also not a mobile cabin, as in order to change its location in the room the cabin must be completely dismantled and later on reassembled.

SUMMARY OF THE INVENTION

The purpose of the invention is to build a monolithic mobile cabin easily relocated in the room, which has a ventilation system and means for sound absorption, whereas, if necessary, cabins may be interconnected by connection devices as modules into a larger set of cabins and, if necessary, detached again and used as individual cabins or smaller sets of cabins.

The cabin comprises a ceiling, a floor, two side wall panels facing each other, a back wall panel and a front wall panel, whereas preferably the back wall panel and/or the front wall panel are made of transparent material and either or both of those comprise a door. The inner structures of the cabin are covered with sound-absorbing material or made from sound-absorbing material. The ventilation system of the cabin includes sound-absorbing devices.

The cabin rests on adjustable support legs or wheels under the floor in such a manner that the cabin has been lifted higher than the ground surface of the room. When in use, the cabin is supported by the adjustable support legs under the floor in such a manner that the wheels are not in contact with the ground surface of the room. The support legs are adjustable from within the cabin through the floor. The wheels rotate 360°, therefore, the mobile cabin, when not in use, can be relocated by one person in a mobile and easy manner in any direction in the room. When the cabin is 'in use', it means that it is permanently immobile and ready for use (i.e. people may be inside it). When the cabin is 'not in use', it means that the support legs are adjusted into such a position that the cabin rests on the wheels and it can be relocated by one person in a mobile and easy manner in the room either to a new location and/or move the cabin in order to connect it to another cabin or detach it from another cabin without dismantling the cabin itself.

The mobile cabin comprises a ventilation system comprising at least one ventilator in the external part of the cabin ceiling and at least one straight one-channel air inlet passage with sound-absorbing device(s) and at least one air inlet in the corner of the internal part of the ceiling and at least one air outlet channel at the contact point of the cabin floor and the side wall panel, which interact to create air circulation, as a result of which air is extracted from the cabin from under the floor through a gap between the cabin and the ground surface of the room.

Optionally, the cabin comprises an electricity, communication and multimedia system and furniture.

The cabin may be interconnected to (and detached from) another cabin by a set of connection devices penetrating it depthwise, so that larger sets of cabins may be formed as modules, if necessary. A set of connection devices comprises a connection element with fastener(s).

According to the invention, also a method for ventilation of a cabin corresponding to the invention is disclosed where the air of the surrounding environment is pulled into the cabin by a ventilator located in the external part of the ceiling through a straight-line one-channel air inlet passage with sound-absorbing devices and a air inlet in the internal part of the ceiling, and expelled from the cabin through the air outlet channel at the contact point of the side wall panel (without penetrating it) and the cabin floor and from there through a gap between the cabin and the ground surface of the room into the surrounding environment. In such a manner, sufficient air circulation in the cabin is ensured and the interior of the cabin is kept within the limits of the prescribed sound absorption. The amount of air absorbed may be adjusted by the number of ventilators and the operating speed thereof.

LIST OF FIGURES

EXEMPLARY EMBODIMENT OF THE INVENTION

Figure 1:
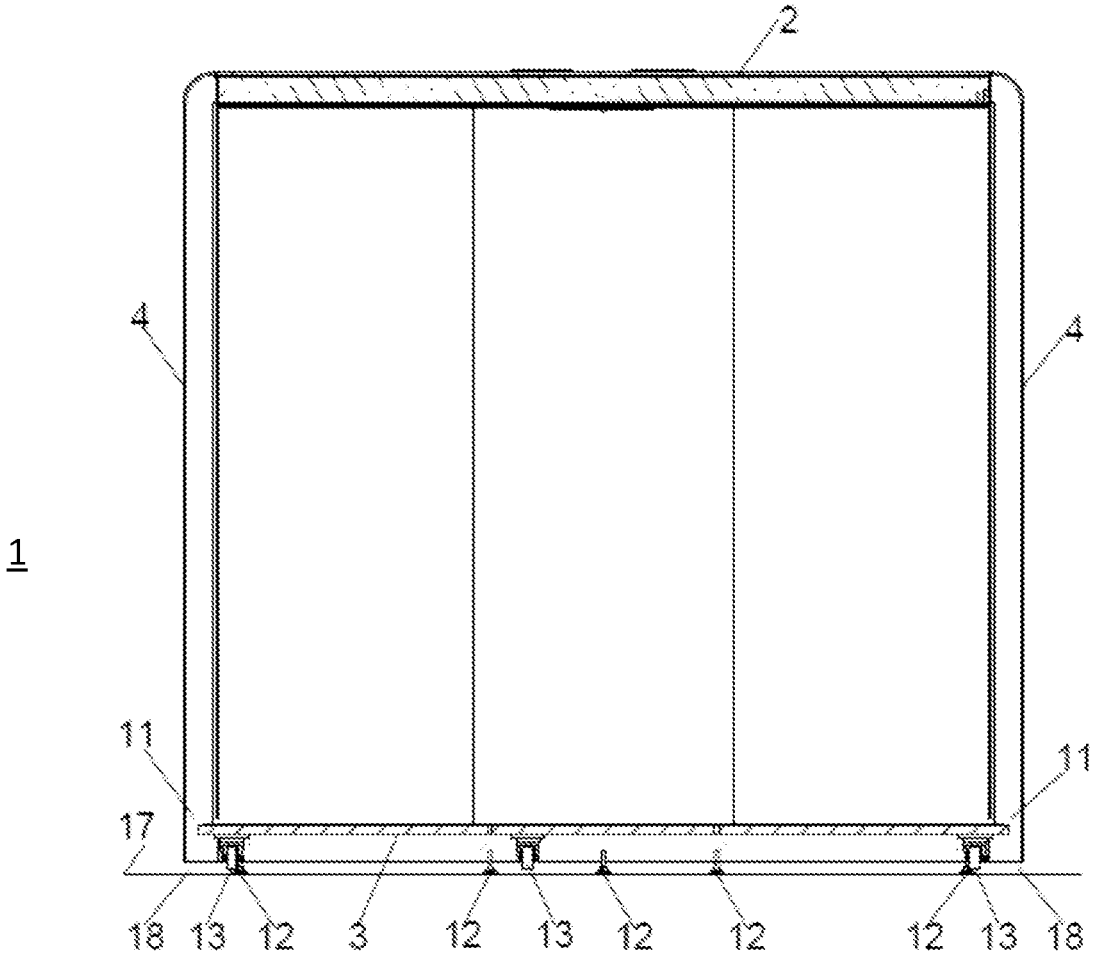
FIG. 1 shows the conceptual solution of the cabin as a cross-section.
Figure 2A:
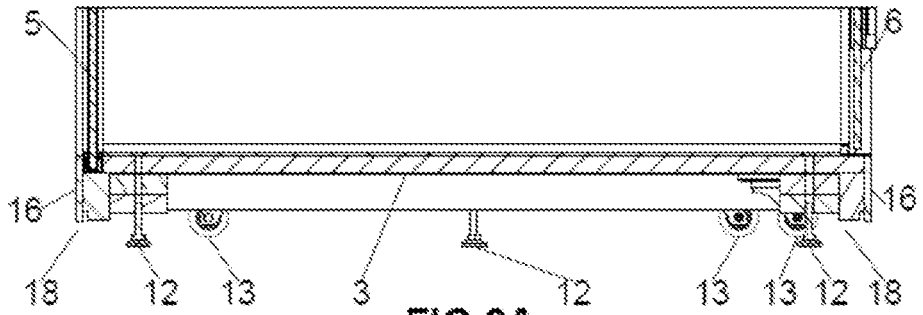
FIG. 2A is a cross-section of the floor where the cabin is 'in use' (supported by support legs)
Figure 2B:
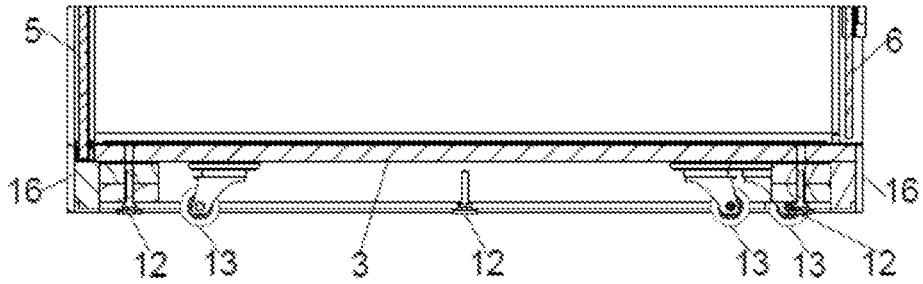
FIG. 2B is a cross-section of the floor where the cabin is 'not in use' (supported by wheels)
Figure 3:
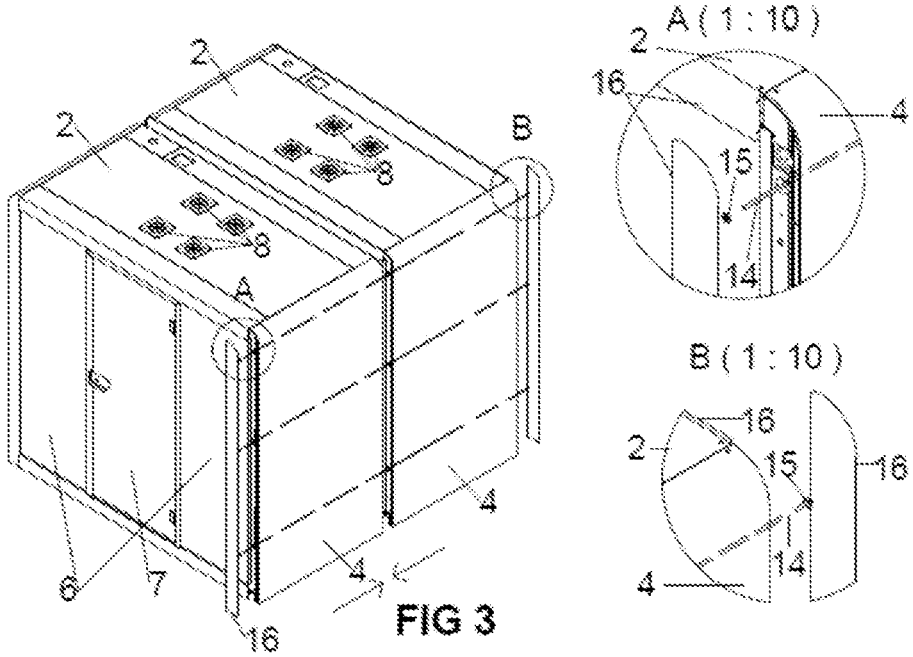
FIG. 3 shows a conceptual solution for attachment and detachment of cabins.
Figure 4:
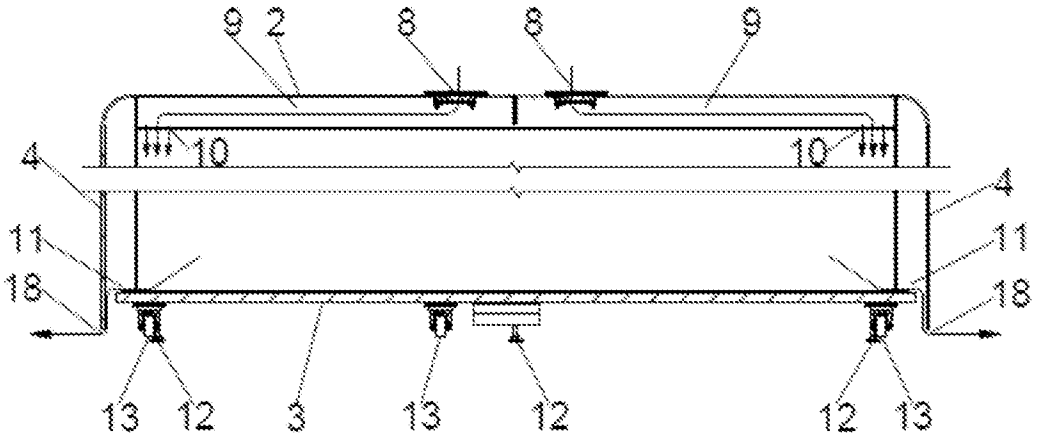
FIG. 4 shows a conceptual solution for the ventilation method.

According to an embodiment of the invention, the mobile cabin 1 with ventilation system comprises a ceiling 2, floor 3, side wall panels 4, back wall panel 5, front wall panel 6, door 7, at least one ventilator 8 in the external part of ceiling 2, an air inlet 10 and ventilator 8 in the internal part of ceiling 2 and an air inlet passage 9 connecting the ventilator 8 and air inlet 10, an air outlet channel 11 at the contact point of the cabin floor 3 and the side wall panel 4 (without penetrating it), adjustable support legs 12 and rotating wheels 13 under the cabin floor 3, connecting element 14 for the cabins comprises fastener(s) 15 and strip 16 with magnetic attachment for the back wall panel 5 and the front wall panel 6 and optionally an electricity, communication and/or multimedia system and furniture installed in the cabin. Door 7 may be simultaneously in the back wall panel 5 and the front wall panel 6 or in only one of those.

The side wall panels 4 are made of durable laminated surfaces whereas specific materials are used for absorbing sound. Also, the inner surfaces of the side wall panels 4 are covered by acoustic panels. The back wall panel 5 and the front wall panel 6 and the door 5 are preferably made from laminated glass with sound-absorbing film between its layers.

The support legs of the cabin are permanently attached under the floor 3 of cabin 1 and are vertically adjustable through openings in the floor 3 of the cabin 1. The wheels 13 are permanently attached under the floor 3 of the cabin and are 360° rotating. The floor 3 of the cabin is not supported by the ground surface of the room 17 (floor of the room) but is supported by support legs 12 or wheels 13 in such a way that the cabin 1 is elevated from the ground surface of the room 17 (floor of the room). Thus, a gap 18 (air gap) remains between the floor 3 of the cabin and the ground surface 17 of the room, which is used in interaction with the ventilation system for expelling air from the cabin 1 and thanks to which it is possible to move the cabin in the room on the wheels 13.

When 'in use', the cabin 1 is supported by the adjustable support legs 12 under the floor 3 of the cabin. Additionally, 360° rotating wheels 13 have been attached under the floor 3 of the cabin by which the mobile cabin, when 'not in use', can be easily relocated in the room in any direction by one person.

When the cabin 1 is 'in use', it means that it is permanently immobile in one location and ready for use (i.e. people may be inside it). When the cabin is 'not in use', it means that the support legs 12 are in such an adjusted (lowered) position that the cabin 1 is supported on the ground surface 17 by the wheels 13 and the cabin may thus be easily relocated in the room by one person either to a new location and/or moved for attachment to or detachment from another cabin.

The cabin 1 is monolithic and is detachably attachable to another cabin by previously removing the back wall panel 5 and/or the front wall panel 6, forming a cabin module out of two or more cabins. For that, connection elements 14 with fasteners 15 are used. A connection element 14 is preferably a metal connection rod with threaded ends and a fastener 15 is preferably a nut. A connection element 14 penetrates the cabin depthwise. When cabins are interconnected by fasteners 15, a connection element 14 is extendable by the connection element 14 of the next cabin. When cabins are interconnected, the strips with magnetic attachments covering the back wall panel 5 and/or the front wall panel 6 of the cabin are removed first and a connection element 14 is installed, which penetrates the cabin, and it is connected by fasteners 15 to the connection element 14 of the other cabin.

The mobile cabin comprises a ventilation system which comprises at least one ventilator 8 in the external part of the ceiling 2 of the cabin 1, which is designed for extracting air from the external environment into the cabin, and at least one air inlet 10 in the corner of the internal part of the ceiling 2 for direction of air into the cabin 1, and an air inlet passage 9 connecting the ventilator 8 and the air inlet 10. Additionally, the ventilation system inside the cabin 1 comprises an air outlet channel 11 at the contact point of the cabin floor 3 and the side wall panel 4, the interaction of which creates air circulation, and as a result, air is expelled from the cabin from underneath the floor through the gap 18 between the cabin 1 and the ground surface 17 of the room. The air inlet passage 9 is, straight, one-channeled and has a sound-absorbing means, which are partition walls of different shape of which a labyrinth is formed (not shown on the drawing), which prevents straight movement of air and sound in the air inlet passage 9 and thus absorbs the sound of the ventilator 8 and the external environment entering the cabin. The invention preferably comprises two air inlets 10 that have been cut into the internal part of the ceiling 2 of the cabin 1 into both corners, which also absorbs the sounds of the external environment entering the cabin, as air does not enter the cabin 1 immediately above the heads of people present in the cabin (e.g. from the central part of the cabin ceiling). A sound-absorbing technical aspect is also the fact that the air outlet channel 11 does not penetrate the side wall panel 4, which also prevents the noise of the external environment entering the cabin.

The invention also discloses a method for ventilation of the mobile cabin corresponding to the invention, which comprises that the air is extracted into the cabin 1 from the surrounding environment by at least one ventilator 8 through a straight single-channel air inlet passage 9 equipped with sound absorption means located in the ceiling 2 of the cabin and an air inlet 10 in the corner of the inner part of the ceiling 2, and the air is expelled from the cabin by air outlet channel 11, which is at the contact point of the cabin floor 3 and the side wall panel 4, underneath the floor 3 of the cabin 1 and from there back into the surrounding environment through the gap 18 between the cabin and the ground surface of the room 17. In such a manner, sufficient air circulation in the cabin is ensured and the interior of the cabin is kept within the limits of the prescribed sound absorption. The amount of air absorbed may be adjusted by the number of ventilators and the operating speed thereof.

The invention can be used in a larger room as a separate meeting room, a place for making phone calls, a place for rest or for another purpose requiring certain privacy and therefore not suitable for an open space. The cabin corresponding to the invention can be easily relocated in a room and adapted to a larger/smaller number of people, as required.

The number of ventilators, air inlet passages, air inlets, air outlet channels, support legs, wheels, connection elements and fasteners used in the illustrated embodiment of the invention is not fixed, as those may be added and/or omitted as required. The number of cabins that can be interconnected is not limited either. Preferably, the initial cabin is sufficient for two people (accommodates two people) and the potential cabin modules are e.g. for 4, 6, 8, etc. people.

| List of references |
|---|
| 1 - cabin |
| 2 - ceiling |
| 3 - floor |
| 4 - side wall panel |
| 5 - back wall panel |
| 6 - front wall panel |
| 7 - door |
| 8 - ventilator |
| 9 - air inlet passage |
| 10 - air inlet |
| 11 - air outlet channel |
| 12 - support leg |
| 13 - wheel |

-continued

| List of references |
|---|
| 14 - connection element |
| 15 - fastener |
| 16 - strip |
| 17 - ground surface of room |
| 18 - gap between the cabin 1 and the ground surface 17 |

The invention claimed is:

1. A mobile cabin with a ventilation system comprising:

a ceiling, a floor, two side wall panels, a back wall panel, and a front wall panel, wherein the ceiling comprises an inner layer and an outer layer, and the side wall panels comprise an inner layer and an outer layer, and the outer layer extends lower down than the inner layer, either the back wall panel or the front wall panel or both comprise a door, and the ventilation system comprises:

at least one straight one-channel air inlet passage in between the inner and the outer layer of the ceiling connecting at least one ventilator penetrating the outer layer of the ceiling and two air inlets penetrating the inner layer of the ceiling proximate to connection of the ceiling and the side walls, whereby air drawn through the at least one ventilator is directed via the at least one straight one-channel air inlet passage through the two air inlets into an inner space of the cabin;

the ventilation system further comprises at least one air outlet formed as a gap between a lower end of the inner layer of at least one of the side wall panels and the floor panel and configured to lead the air from the inner space of the cabin into a space between the inner and outer layers of the at least one side wall panel and further down toward an open lower end of the space between the outer and the inner layers of the at least one side wall;

and wherein the cabin further has adjustable support legs configured to support the cabin and to allow the open lower end of the space between the outer and the inner layers of the at least one side wall panel to be above ground to enable air outflow when the cabin is in use, and 360° rotating wheels configured to ease moving the cabin when needed, and at least one connection element and at least one fastener configured to detachably connect the cabin to a second cabin.

2. The cabin according to claim 1, wherein when the cabin is in use, the support legs are adjusted into a position where the cabin rests on the support legs and the wheels are not in contact with the ground surface of the room.

3. The cabin according to claim 1, wherein when the cabin is not in use, the support legs are adjusted into a position where the cabin rests on the wheels.

4. The cabin according to claim 1, wherein the support legs are adjustable from within the cabin through the floor.

5. The cabin according to claim 1, wherein the cabin has two air outlet channels at connection points of the floor panel and the side wall panel.

6. The cabin according to claim 1, wherein the at least one connection element is a metal rod having threaded ends penetrating the cabin horizontally from the front wall to the back wall the fastener is a nut.

7. The cabin according to claim 6, wherein the connection element is extendable and connectable with a connection element of the second cabin with the fastener.

8. The cabin according to claim 1, wherein the back wall panel, the front wall panel or both the back and front wall panels have magnetic attachments for attaching the cabin to the second cabin.

9. The cabin according to claim 1, wherein the at least one straight one-channel air inlet passage comprises partition walls forming a labyrinth structure inside the air inlet passage.

10. A method for ventilation of a mobile cabin of claim 1, comprising:

directing the air from the at least one ventilator through the outer layer of the ceiling into the straight one channel air passage and further through the inner layer of the ceiling through the two inlets proximate to connection of the ceiling and the side walls into inside of the cabin;

expelling the air from the cabin through the gap forming an air outlet channel at the connection point of the side wall panel and the floor panel into the space between the inner and outer layers of at least one side wall panel, and further down toward an open lower end of the space between the outer and the inner layers of the side wall panel into the surrounding environment while the adjustable support legs support the cabin and allow the open lower end of the space between the outer and the inner layers of the at least one side wall panel to be above ground; and adjusting amount of extracted air so that sufficient air circulation is ensured inside the cabin and the sounds from the external environment do not exceed a desired limit.

11. The method according to claim 10, wherein the cabin has two air outlet channels at connection points of the floor panel and the side wall panel.

12. The method according to claim 10, wherein a labyrinth is formed in the straight one channel air passage.

* * * * *